US009310142B2

(12) United States Patent
Maloney et al.

(10) Patent No.: US 9,310,142 B2
(45) Date of Patent: Apr. 12, 2016

(54) COMPLEMENTARY RIBS FOR ADDED STRUCTURAL STRENGTH

(75) Inventors: Steven Maloney, Canton, MI (US); Daniel Tylutki, Livonia, MI (US); Tyler Last, Ada, MI (US); Oguzhan Colpan, Waterford, MI (US)

(73) Assignees: Denso International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 0 days.

(21) Appl. No.: 13/608,276

(22) Filed: Sep. 10, 2012

(65) Prior Publication Data

US 2014/0069938 A1 Mar. 13, 2014

(51) Int. Cl.
*F28F 9/02* (2006.01)
*F28D 1/053* (2006.01)

(52) U.S. Cl.
CPC ..... *F28F 9/0224* (2013.01); *F28D 1/05366* (2013.01); *F28F 2225/08* (2013.01)

(58) Field of Classification Search
CPC ... F28D 1/0316; F28D 1/0333; F28D 1/0358; F28D 1/05333; F28D 1/05366; F28D 9/001; F28D 9/02; F28D 9/0224; F28D 9/0226; H01L 23/3672; H01L 23/467
USPC ..... 165/148–149, 173, 185; 220/581, 592, 220/669–670, 675
See application file for complete search history.

(56) References Cited

U.S. PATENT DOCUMENTS

| | | | | |
|---|---|---|---|---|
| 1,339,752 | A * | 5/1920 | Franz | 165/149 |
| 4,289,507 | A * | 9/1981 | Cadars et al. | 96/201 |
| 4,331,201 | A * | 5/1982 | Hesse | 165/153 |
| 4,423,769 | A * | 1/1984 | Cadars | 165/109.1 |
| 4,940,086 | A * | 7/1990 | Stay | 165/173 |
| 4,997,035 | A * | 3/1991 | Beatenbough et al. | 165/173 |
| 5,228,511 | A * | 7/1993 | Boquel et al. | 165/149 |
| 6,082,446 | A * | 7/2000 | Ahaus et al. | 165/173 |
| 7,121,329 | B2 * | 10/2006 | Shields et al. | 165/149 |
| 7,198,097 | B2 | 4/2007 | Powers et al. | |
| 2003/0141047 | A1 * | 7/2003 | Lamich | 165/173 |
| 2003/0205367 | A1 * | 11/2003 | Shields et al. | 165/173 |
| 2005/0133213 | A1 | 6/2005 | Powers et al. | |
| 2007/0261835 | A1 | 11/2007 | Powers et al. | |

OTHER PUBLICATIONS

Office Action dated Sep. 1, 2015 in corresponding Chinese Application No. 201310373099.5.

* cited by examiner

*Primary Examiner* — Anthony Stashick
*Assistant Examiner* — Kaushikkumar Desai
(74) *Attorney, Agent, or Firm* — Harness, Dickey & Pierce, P.L.C.

(57) ABSTRACT

A radiator tank for a radiator. The radiator tank includes a plurality of first reinforcement members spaced apart along a first sidewall. A plurality of second reinforcement members are spaced apart along a second sidewall. A plurality of third reinforcement members are spaced apart along an upper portion that extends from the first sidewall to the second sidewall. Both the first and the second reinforcement members are on one of an outer surface or an inner surface of the radiator tank. The third reinforcement members are on the other one of the outer surface or the inner surface. The first and the second reinforcement members terminate prior to reaching the upper portion, and the third reinforcement members terminate prior to reaching both the first sidewall and the second sidewall.

20 Claims, 2 Drawing Sheets

COMPLEMENTARY RIBS FOR ADDED STRUCTURAL STRENGTH

FIELD

The present disclosure relates to structural reinforcement ribs, such as ribs of a radiator tank, for added structural strength.

BACKGROUND

This section provides background information related to the present disclosure which is not necessarily prior art.

A radiator tank is repeatedly subject to large changes in pressure, which results in repeated expansion and contraction of the tank. This repeated expansion and contraction can damage the radiator tank, such as at an interface between the radiator tank and a radiator core. Typical radiator tanks are without structural reinforcements sufficient to reduce stress on the radiator tank caused by pressure changes therein, and do not include structural reinforcements that can be implemented in an efficient and cost-effective manner.

SUMMARY

This section provides a general summary of the disclosure, and is not a comprehensive disclosure of its full scope or all of its features.

The present teachings provide for a radiator tank for a radiator. The radiator tank includes a plurality of first reinforcement members spaced apart along a first sidewall. A plurality of second reinforcement members are spaced apart along a second sidewall. A plurality of third reinforcement members are spaced apart along an upper portion that extends from the first sidewall to the second sidewall. Both the first and the second reinforcement members are on one of an outer surface or an inner surface of the radiator tank. The third reinforcement members are on the other one of the outer surface or the inner surface. The first and the second reinforcement members terminate prior to reaching the upper portion, and the third reinforcement members terminate prior to reaching both the first sidewall and the second sidewall.

The present teachings also provide for a radiator tank for a radiator that includes a plurality of first reinforcement ribs spaced apart along a first sidewall. A plurality of second reinforcement ribs are spaced apart along a second sidewall. A plurality of third reinforcement ribs are spaced apart along an upper portion that extends from the first sidewall to the second sidewall. The first reinforcement ribs and the second reinforcement ribs are on opposing inner surfaces of the first sidewall and the second sidewall respectively. The third reinforcement ribs are on an outer surface of the upper surface. The first and the second reinforcement ribs terminate prior to the upper portion. The third reinforcement ribs terminate prior to both the first sidewall and the second sidewall.

The present teachings further provide for a radiator tank that includes a first sidewall having a first inner surface. The first sidewall is configured to couple with a radiator plate of a radiator. A second sidewall includes a second inner surface. The second sidewall is configured to couple with the radiator plate. The second inner surface is opposite to the first inner surface. An upper portion extends between the first sidewall and the second sidewall. The upper portion includes an outer surface. A plurality of spaced apart first reinforcement ribs extend along the first inner surface of the first sidewall generally perpendicular to the radiator plate. The first reinforcement ribs terminate prior to reaching the upper portion. A plurality of spaced apart second reinforcement ribs extend along the second inner surface of the second sidewall generally perpendicular to the radiator plate. The second reinforcement ribs terminate prior to reaching the upper portion. A plurality of third reinforcement ribs extend from the outer surface of the upper portion. The third reinforcement ribs terminate prior to reaching the first sidewall and the second sidewall.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
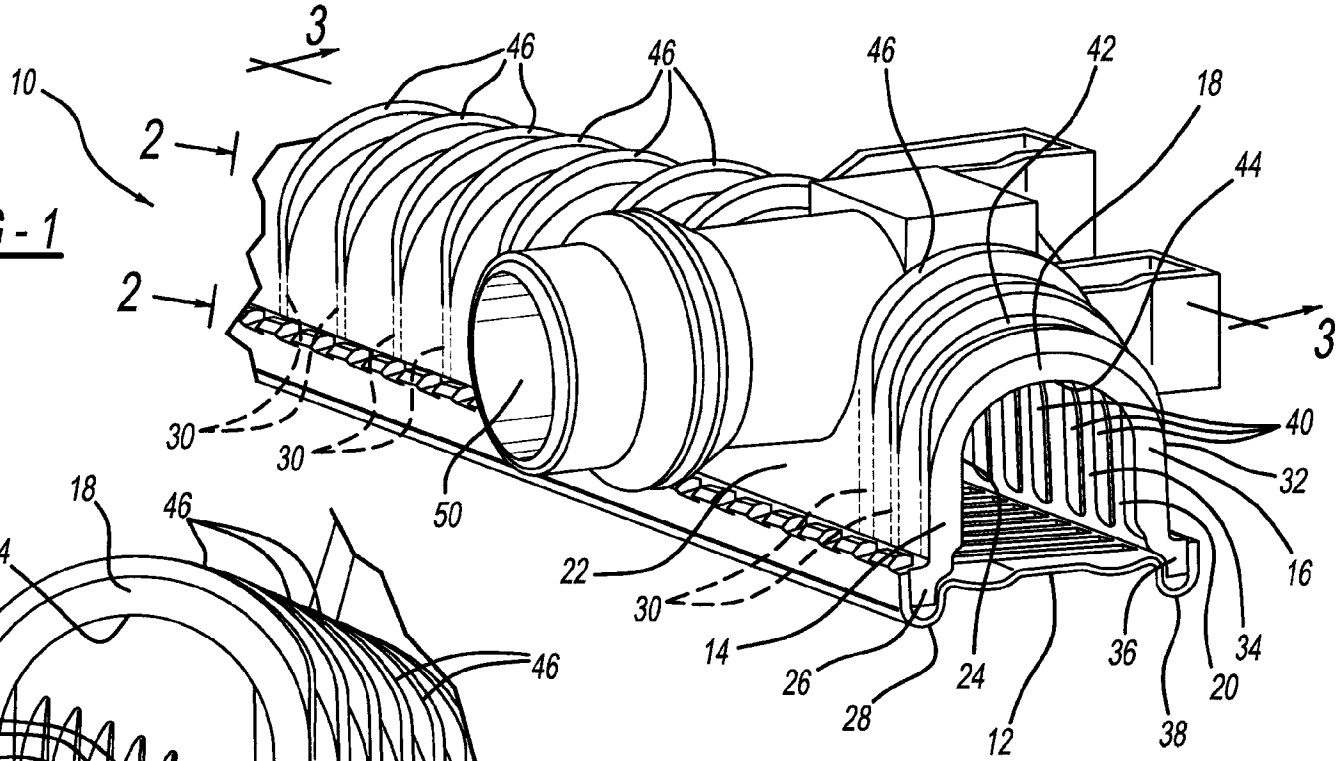
FIG. 1 is a perspective view of a radiator tank according to the present teachings coupled to a radiator plate.

With initial reference to FIG. 1, a radiator tank according to the present teachings is illustrated at reference 10. The radiator tank 10 is coupled to a radiator plate 12. The radiator tank 10 generally includes a first sidewall 14, a second sidewall 16, and an upper portion 18 that extends from the first sidewall 14 to the second sidewall 16. The first sidewall 14, the second sidewall 16, the upper portion 18, and the radiator plate 12 generally define an interior cavity 20 of the radiator tank 10. The interior cavity 20 is configured to house, for example, radiator coolant.

Figure 2:
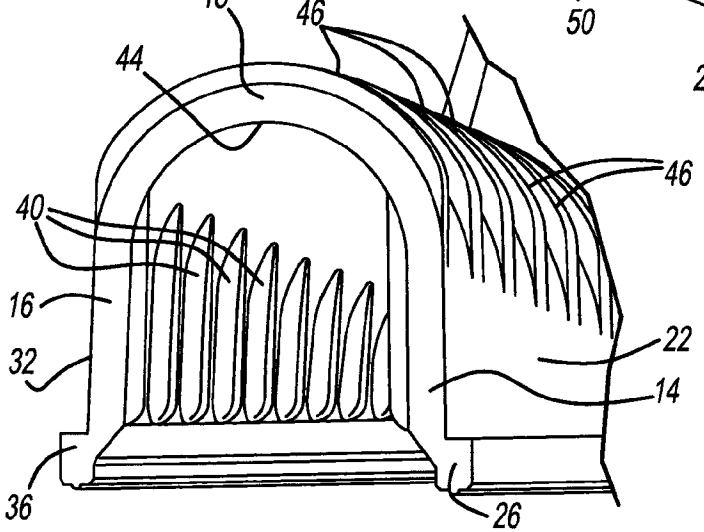
FIG. 2 is another perspective view of the radiator tank of FIG. 1 decoupled from the radiator plate, the view taken in the direction of lines 2-2 of FIG. 1.
Figure 3:
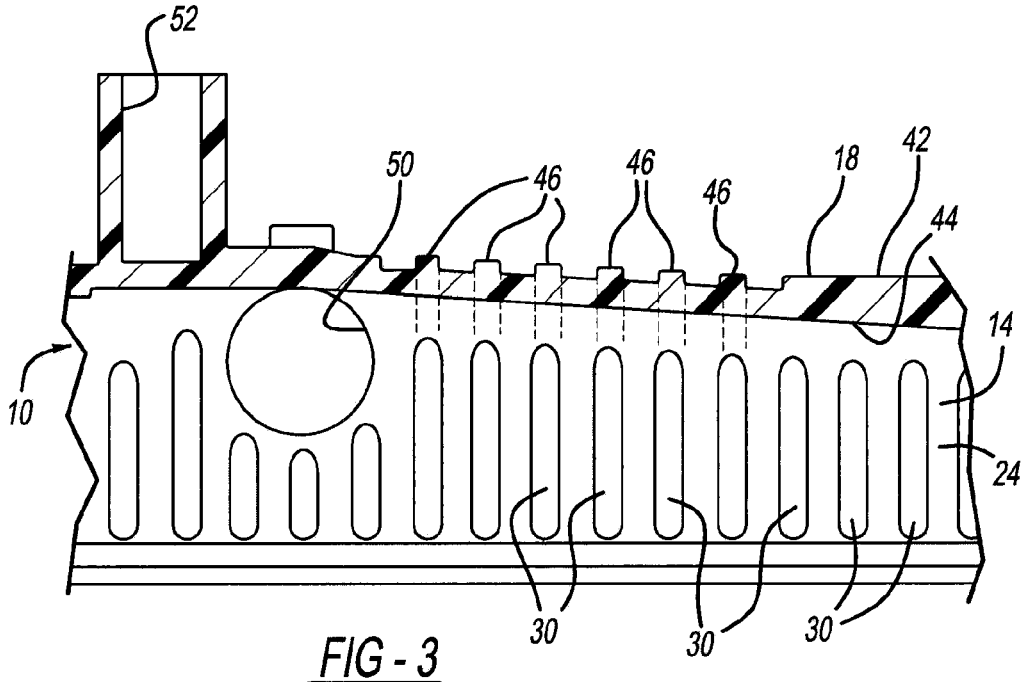
FIG. 3 is a cross-sectional view of the radiator tank of FIG. 1 taken along line 3-3 of FIG. 1.

With continued reference to FIG. 1 and additional reference to FIGS. 2 and 3, the first sidewall 14 generally includes a first outer surface 22 and a first inner surface 24, which is opposite to the first outer surface 22. The first outer surface 22 and the first inner surface 24 extend generally parallel to one another along a length of the radiator tank 10. Extending from the first sidewall 14 is a first flange 26, which also extends generally along the length of the radiator tank 10. The first flange 26 can be received within a first receptacle 28 of the radiator plate 12, and secured within the first receptacle 28 to mount the radiator tank 10 to the radiator plate 12.

The first sidewall 14 further includes a plurality of first reinforcement ribs 30. The first reinforcement ribs 30 extend generally perpendicular to the radiator plate 12 and are spaced apart along the first sidewall 14. The first reinforcement ribs 30 extend from an area proximate to the first flange 26 and terminate prior to reaching the upper portion 18. As illustrated, the first reinforcement ribs 30 are protrusions extending from the first inner surface 24. Alternatively, the first reinforcement ribs 30 may be provided at any other suitable location on the first sidewall 14. For example, the first reinforcement ribs 30 may be provided on the first outer surface 22. The first reinforcement ribs 30 may be any suitable reinforcement member that enhances the structural rigidity of the first sidewall 14. Thus, one or more of the first reinforcement ribs 30 need not take the form of a rib. The first reinforcement ribs 30 can be unitarily molded with the radiator tank 10, or can be separate components that are attached to the first sidewall 14 in any suitable manner, such as by welding.

The second sidewall 16 generally includes a second outer surface 32 and a second inner surface 34. The second outer surface 32 is opposite to the second inner surface 34. The second outer and inner surfaces 32 and 34 extend generally parallel to one another along the length of the radiator tank 10. The second inner surface 34 faces the first inner surface 24. Extending from the second sidewall 16 is a second flange 36. The second flange 36 extends along a length of the second sidewall 16 and is configured to be received and secured within a second receptacle 38 of the radiator plate 12 in order to mount the radiator tank 10 to the radiator plate 12.

The second sidewall 16 further includes second reinforcement ribs 40. The second reinforcement ribs 40 are similar to the first reinforcement ribs 30. The second reinforcement ribs 40 extend generally perpendicular to the radiator plate 12 and are spaced apart long the second sidewall 16. The second reinforcement ribs 40 extend from an area proximate to the second flange 36 and terminate prior to reaching the upper portion 18. As illustrated, the second reinforcement ribs 40 are protrusions extending from the second inner surface 34. Alternatively, the second reinforcement ribs 40 may be provided at any other suitable location on the second sidewall 16. For example, the second reinforcement ribs 40 may be provided on the second outer surface 32. The second reinforcement ribs 40 may be any suitable reinforcement member that enhances the structural rigidity of the second sidewall 16. Thus, one or more of the second reinforcement ribs 40 need not take the form of a rib. The second reinforcement ribs 40 can be unitarily molded with the radiator tank 10, or can be separate components that are attached to the second sidewall 16 in any suitable manner, such as by welding.

The second reinforcement ribs 40 can be arranged such that most or all of the second reinforcement ribs 40 are aligned with the first reinforcement ribs 30. Alternatively, the first reinforcement ribs 30 and the second reinforcement ribs 40 can be staggered with respect to one another such that the second reinforcement ribs 40 are not opposite to the first reinforcement ribs 30, but rather opposite to spaces between the first reinforcement ribs 30 and thus interleaved with the first reinforcement ribs 30.

The upper portion 18 includes a third outer surface 42 and a third inner surface 44, which is generally opposite to the third outer surface 42. The third outer surface 42 and the third inner surface 44 are both generally curved and generally extend along a length of the radiator tank 10. The third inner surface 44 is opposite to the radiator plate 12 and is generally concave with respect to the radiator plate 12. The third outer surface 42 is generally convex with respect to the radiator plate 12.

The upper portion 18 further includes a plurality of third reinforcement ribs 46 extending from the third outer surface 42. The third reinforcement ribs 46 are generally spaced apart along the length of the upper portion 18, and each extend generally from the first sidewall 14 to the second sidewall 16. The third reinforcement ribs 46 terminate generally at, or prior to reaching, each of the first sidewall 14 and the second sidewall 16. The third reinforcement ribs 46 generally extend from a point opposite to where the first reinforcement ribs 30 terminate prior to reaching the upper portion 18, to a point opposite to where the second reinforcement ribs 40 terminate prior to reaching the upper portion 18.

The third reinforcement ribs 46 can alternatively be arranged on the third inner surface 44. When the third reinforcement ribs 46 are on the third inner surface 44, the first and the second reinforcement ribs 30 and 40 will be arranged on the first outer surface 22 and the second outer surface 32 respectively. The third reinforcement ribs 46 can be any suitable reinforcement member that enhances the structural rigidity of the upper portion 18. Thus, one or more of the third reinforcement ribs 46 need not take the form of a rib. The third reinforcement ribs 46 can be unitarily molded with the radiator tank 10, or can be separate components that are attached to the upper portion 18 in any suitable manner, such as by welding.

Figure 4:
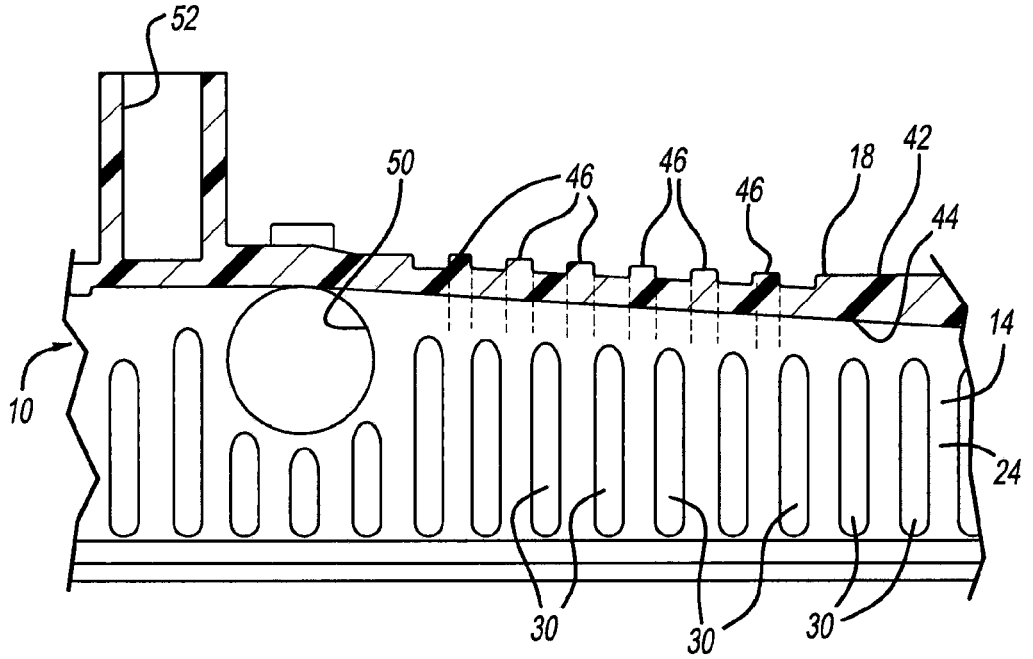
FIG. 4 is a cross-sectional view of another radiator tank according to the present teachings.

As illustrated in FIGS. 1-3, the third reinforcement ribs 46 are generally aligned with each of the first reinforcement ribs 30 and the second reinforcement ribs 40. Therefore, each one of the first reinforcement ribs 30, the second reinforcement ribs 40, and the third reinforcement ribs 46, combine to generally provide a single reinforcement rib extending about the radiator tank 10 from about the first flange 26 to about the second flange 36. With additional reference to FIG. 4, the third reinforcement ribs 46 may alternatively be arranged offset with respect to each of the first reinforcement ribs 30 and the second reinforcement ribs 40. Arranging the first, second and, the third reinforcement ribs 30, 40, and 46 in either manner enhances the structural strength of the radiator tank 10. Therefore, the radiator tank 10 can withstand large pressure changes within the interior cavity 20 without being damaged, particularly where the radiator tank 10 connects to the radiator plate 12. Arranging the first, second, and the third reinforcement ribs 30, 40, and 46 in either manner permits the radiator tank 10 to be manufactured using a single die without additional slides, which provides for a more efficient and less costly manufacturing process.

The radiator tank 10 further defines a connection port 50 and a vehicle mount 52. The connection port 50 is generally cylindrical and extends from the first outer surface 22 of the first sidewall 14. The connection port 50 is configured to direct coolant to and from the radiator tank 10. The vehicle mount 52 extends from the upper portion 18 of the third outer surface 42.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A radiator tank for a radiator comprising:

a plurality of first reinforcement members spaced apart along a first sidewall;

a plurality of second reinforcement members spaced apart along a second sidewall;

a plurality of third reinforcement members spaced apart along an upper portion that extends from the first sidewall to the second sidewall;

wherein:

both the first and the second reinforcement members are on an inner sidewall surface of the radiator tank opposite to an outer sidewall surface of the radiator tank that is smooth, and the third reinforcement members are on an upper outer surface of the radiator tank that is opposite to an upper inner surface of the radiator tank that is smooth;

the first and the second reinforcement members terminate prior to reaching the upper portion, and the third reinforcement members terminate prior to reaching both the first sidewall and the second sidewall;

the plurality of first reinforcement members do not directly contact the plurality of second reinforcement members;

the third reinforcement members extend from a first area opposite to where the first reinforcement members terminate prior to reaching the upper portion, and the third reinforcement members extend to a second area opposite to where the second reinforcement members terminate prior to reaching the upper portion such that the third reinforcement members do not generally overlap with either the first reinforcement members or the second reinforcement members; and the radiator tank is formed from a single die without additional die slides.

2. The radiator tank of claim 1, wherein the first sidewall is opposite to and spaced apart from the second sidewall, and the first sidewall extends parallel to the second sidewall.

3. The radiator tank of claim 2, wherein the third reinforcement members are one of aligned with or offset from both the first and the second reinforcement members.

4. The radiator tank of claim 2, wherein the plurality of first reinforcement members are aligned with the plurality of second reinforcement members.

5. The radiator tank of claim 2, wherein the plurality of first reinforcement members are offset from the plurality of second reinforcement members.

6. The radiator tank of claim 1, wherein the first sidewall and the second sidewall are both configured to couple with a radiator plate of the radiator.

7. The radiator tank of claim 1, further comprising a radiator including a radiator plate, the radiator tank is coupled to the radiator.

8. The radiator tank of claim 1, wherein each of the first, second, and third reinforcement members are reinforcement ribs.

9. A radiator tank for a radiator comprising:

a plurality of first reinforcement ribs spaced apart along a first sidewall;

a plurality of second reinforcement ribs spaced apart along a second sidewall;

a plurality of third reinforcement ribs spaced apart along an upper portion that extends from the first sidewall to the second sidewall;

wherein:

the first reinforcement ribs and the second reinforcement ribs are on opposing inner surfaces of the first sidewall and the second sidewall respectively opposite to smooth outer surfaces of the first sidewall and the second sidewall, and the third reinforcement ribs are on an outer surface of the upper surface that is opposite to a smooth inner surface of the upper surface;

the first and the second reinforcement ribs terminate prior to the upper portion, and the third reinforcement ribs terminate prior to both the first sidewall and the second sidewall;

the plurality of first reinforcement ribs do not directly contact the plurality of second reinforcement ribs;

the third reinforcement ribs extend from a first area opposite to where the first reinforcement ribs terminate prior to reaching the upper portion, and the third reinforcement ribs extend to a second area opposite to where the second reinforcement ribs terminate prior to reaching the upper portion such that the third reinforcement ribs do not generally overlap with either the first reinforcement ribs or the second reinforcement ribs; and the radiator tank is formed from a single die without additional die slides.

10. The radiator tank of claim 9, wherein the first sidewall is opposite to and spaced apart from the second sidewall.

11. The radiator tank of claim 9, wherein the first sidewall is parallel to the second sidewall.

12. The radiator tank of claim 9, wherein each of the plurality of first reinforcement ribs are aligned with each of the plurality of second reinforcement ribs.

13. The radiator tank of claim 9, wherein the plurality of first reinforcement ribs are interleaved with the plurality of second reinforcement ribs.

14. The radiator tank of claim 12, wherein each of the plurality of third reinforcement ribs are aligned with each of the plurality of first reinforcement ribs and each of the plurality of second reinforcement ribs.

15. A radiator tank for a radiator comprising:

a first sidewall including a first inner surface, the first sidewall is configured to couple with a radiator plate of the radiator;

a second sidewall including a second inner surface, the second sidewall is configured to couple with the radiator plate, the second inner surface is opposite to the first inner surface;

an upper portion extending between the first sidewall and the second sidewall, the upper portion including an outer surface;

a plurality of spaced apart first reinforcement ribs extending along the first inner surface of the first sidewall generally perpendicular to the radiator plate and opposite to a first outer surface that is smooth, the first reinforcement ribs terminate prior to reaching the upper portion;

a plurality of spaced apart second reinforcement ribs extending along the second inner surface of the second sidewall generally perpendicular to the radiator plate and opposite to a second outer surface that is smooth, the second reinforcement ribs terminate prior to reaching the upper portion; and a plurality of third reinforcement ribs extending from the outer surface of the upper portion opposite to an inner surface of the upper portion that is smooth, the third reinforcement ribs terminate prior to reaching the first sidewall and the second sidewall;

wherein:

the plurality of spaced apart first reinforcement ribs do not directly contact the plurality of spaced apart second reinforcement ribs;

the plurality of third reinforcement ribs extend from a first area opposite to where the plurality of first reinforcement ribs terminate prior to reaching the upper portion, and the plurality of third reinforcement ribs extend to a second area opposite to where the plurality of second reinforcement ribs terminate prior to reaching the upper portion such that the plurality of third reinforcement ribs do not generally overlap with either the plurality of first reinforcement ribs or the plurality of second reinforcement ribs; and the radiator tank is formed from a single die without additional die slides.

16. The radiator tank of claim 15, wherein the third reinforcement ribs are aligned with both the first reinforcement ribs and the second reinforcement ribs.

17. The radiator of claim 15, wherein the third reinforcement ribs are offset from both the first reinforcement ribs and the second reinforcement ribs.

18. The radiator of claim 15, wherein each of the first reinforcement ribs are aligned with each of the second reinforcement ribs.

19. The radiator of claim 15, wherein each of the first reinforcement ribs are offset from each of the second reinforcement ribs.

20. The radiator of claim 15, wherein each of the first ribs extend to about a first flange of the first sidewall, and each of the second ribs extend to about a second flange of the second sidewall, both the first flange and the second flange are configured to couple with the radiator plate.

* * * * *